US009366074B2

(12) United States Patent
Sundberg et al.

(10) Patent No.: US 9,366,074 B2
(45) Date of Patent: Jun. 14, 2016

(54) SECURITY GATE WITH PRESSURE-MOUNT SYSTEM

(71) Applicant: Cosco Management, Inc., Wilmington, DE (US)

(72) Inventors: Brian C Sundberg, Chester, NH (US); Kurt Nygren, Harvard, MA (US); Andrew W Marsden, Hingham, MA (US); Raul G Pereira, Cumberland, RI (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 0 days.

(21) Appl. No.: 14/486,658

(22) Filed: Sep. 15, 2014

(65) Prior Publication Data

US 2015/0075079 A1 Mar. 19, 2015

Related U.S. Application Data

(60) Provisional application No. 61/878,841, filed on Sep. 17, 2013.

(51) Int. Cl.

| | |
|---|---|
| ***E06B 9/02*** | (2006.01) |
| ***E06B 9/06*** | (2006.01) |
| *E06B 9/00* | (2006.01) |

(52) U.S. Cl.

CPC ..... *E06B 9/02* (2013.01); *E06B 9/0638* (2013.01); *E06B 2009/002* (2013.01)

(58) Field of Classification Search

CPC ..... E06B 9/02; E06B 9/06; E06B 9/0607; E06B 9/0653; E06B 9/0676; E06B 9/063; E06B 9/0623; E06B 9/0638

USPC ..... 49/55, 57

See application file for complete search history.

(56) References Cited

U.S. PATENT DOCUMENTS

| | | | | |
|---|---|---|---|---|
| 227,568 | A | 5/1880 | Owen | |
| 433,343 | A | 7/1890 | Hawley | |
| 591,315 | A | 10/1897 | Wilson | |
| 1,055,127 | A * | 3/1913 | Boger | B62D 33/0273 160/217 |
| 1,672,947 | A | 6/1928 | Lefforge | |
| 2,565,905 | A | 8/1951 | Belau | |
| 2,584,706 | A * | 2/1952 | Hulsey, Jr. | E06B 9/01 292/2 |
| 2,859,811 | A * | 11/1958 | Rusch | 160/136 |
| 2,928,146 | A | 3/1960 | Kuniholm | |
| 3,163,205 | A | 12/1964 | Gottlieb | |
| 3,216,482 | A | 11/1965 | Lindholm | |
| 3,489,201 | A * | 1/1970 | Curry et al. | 160/225 |
| 3,908,787 | A | 9/1975 | Wenger et al. | |
| 4,149,342 | A | 4/1979 | Bowers | |
| 4,607,455 | A | 8/1986 | Bluem et al. | |
| 4,677,791 | A | 7/1987 | Larson et al. | |
| 4,712,773 | A | 12/1987 | Larson | |
| 5,134,806 | A | 8/1992 | Burkart, Jr. | |
| D341,207 | S | 11/1993 | Freese et al. | |
| 5,335,452 | A | 8/1994 | Taylor | |

(Continued)

FOREIGN PATENT DOCUMENTS

| | | |
|---|---|---|
| FR | 1525145 | 3/1967 |

*Primary Examiner* — Katherine Mitchell
*Assistant Examiner* — Catherine A Kelly
(74) *Attorney, Agent, or Firm* — Barnes & Thornburg LLP

(57) ABSTRACT

A security gate includes a first panel and a second panel arranged to move relative to the first panel to close a doorway. The gate also includes a lock for locking the second panel to the first panel to establish the width of the gate.

23 Claims, 13 Drawing Sheets

(56) References Cited

U.S. PATENT DOCUMENTS

| | | | | |
|---|---|---|---|---|
| 5,437,115 | A * | 8/1995 | Freese | E06B 9/02 49/449 |
| 5,437,134 | A * | 8/1995 | Donnelly | E06B 9/0623 160/161 |
| 5,535,552 | A | 7/1996 | Stern | |
| 5,771,505 | A | 6/1998 | Reynolds | |
| 5,924,242 | A | 7/1999 | Macari et al. | |
| 6,027,104 | A | 2/2000 | Alexander et al. | |
| 6,161,334 | A | 12/2000 | Goodin | |
| 6,640,509 | B2 | 11/2003 | Clewis | |
| 6,681,523 | B1 | 1/2004 | Stener | |
| D502,551 | S | 3/2005 | Hotaling et al. | |
| 7,152,372 | B2 | 12/2006 | Cheng | |
| D556,344 | S | 11/2007 | Robinson et al. | |
| 7,658,220 | B2 | 2/2010 | Yates | |
| 7,716,874 | B2 * | 5/2010 | Ventrola | 49/55 |
| D635,470 | S | 4/2011 | Dunn et al. | |
| 7,950,184 | B2 | 5/2011 | Flannery | |
| 8,261,490 | B2 | 9/2012 | Flannery et al. | |
| 8,267,244 | B2 | 9/2012 | Dunn et al. | |
| 8,297,336 | B2 | 10/2012 | Yates | |
| 8,341,886 | B2 | 1/2013 | Yates | |
| 8,578,656 | B2 * | 11/2013 | Yates et al. | 49/465 |
| 2006/0092378 | A1 | 5/2006 | Marsden et al. | |
| 2006/0185253 | A1 | 8/2006 | Marsden et al. | |
| 2006/0260195 | A1 | 11/2006 | Witman et al. | |
| 2007/0017156 | A1 * | 1/2007 | Robinson et al. | 49/55 |
| 2011/0225890 | A1 | 9/2011 | Greenwood et al. | |
| 2012/0144745 | A1 | 6/2012 | Yates et al. | |
| 2013/0086840 | A1 | 4/2013 | Marsden et al. | |
| 2015/0267463 | A1 * | 9/2015 | Yager Grad | E06B 9/06 49/465 |

* cited by examiner

SECURITY GATE WITH PRESSURE-MOUNT SYSTEM

PRIORITY CLAIM

This application claims priority under 35 U.S.C. §119(e) to U.S. Provisional Application Ser. No. 61/878,841, filed Sep. 17, 2013, which is expressly incorporated by reference herein.

BACKGROUND

The present disclosure relates to movable barriers, and particularly to security gates. More particularly, the present disclosure relates to pressure-mounted juvenile gates for use in a doorway inside a dwelling.

SUMMARY

A security gate in accordance with the present disclosure includes two movable panels. The panels are arranged to be moved relative to one another to vary the width of the security gate.

In illustrative embodiments, a security gate in accordance with the present disclosure includes a first panel adapted to lie in a doorway and mate with a first doorjamb bordering the doorway and a second panel mounted on the first panel for sliding movement relative to the first panel to mate with an opposing second doorjamb bordering the doorway. The security gate further includes a hand-actuated panel mover coupled to the first and second panels. The panel mover can be operated by a caregiver to spread the first and second panels apart to pressure-mount an outer edge of the first panel to the first doorjamb and an outer edge of the second door panel to the second doorjamb so that the panels are retained in stationary positions relative to one another and to the doorjambs to block juvenile movement through the doorway.

In illustrative embodiments, the panel mover includes a lock rod mounted on the first panel for pivotable movement about a first-panel pivot axis and a lock-release rod mounted on the second panel for pivotable movement about a second-panel pivot axis. The panel mover further includes a rod coupler that is configured to tether a free end of the pivotable lock rod to move back and forth along a middle portion of the lock-release rod during relative movement of the first and second panels to widen or narrow the width of the gate. A tab included in the pivotable lock rod can be inserted into a tab-receiver notch formed in the lock-release rod by pivoting the lock-release rod manually to rigidify the panel mover so as to block any further pivotable movement of the lock rod about the first-panel pivot axis and to block any further pivotable movement of the lock-release rod about the second-panel pivot axis. Once the panel mover is rigidified, movement of the second panel relative to the first panel is blocked and a fixed width of the gate is established.

In illustrative embodiments, the lock-release rod is formed to include a series of separate tab-receiver notches extending along the length of the lock-release rod. The lock rod includes a tab that is sized to fit into each of the tab-receiver notches. The tab in the lock rod can be inserted into any of the tab-receiver notches formed in the lock-release rod to anchor the lock-release rod to the lock rod to lock the panels together so that relative movement between the first and second panels is blocked and the width of the gate is established. The width of the gate can be changed by pivoting the lock-release rod upwardly to disengage the tab from one of the tab-receiver notches to free the panels for relative movement and then either drawing the panels together manually to establish a narrower gate width or spreading the panels apart manually to establish a wider gate width.

In illustrative embodiments, the rod coupler included in the panel mover is configured to provide means for allowing movement of the lock-release rod relative to the lock rod and for allowing pivoting motion of the lock rod about the first-panel pivot axis and pivoting motion of the lock-release rod about the second-panel pivot axis to retain a free end of the tab in close proximity to the series of tab-receiver notches without allowing movement of the tab into one of the tab-receiver notches during movement of the second panel relative to the first panel to widen or narrow the width of the gate. The rod coupler includes a first flange-support rail coupled to the lock-release rod and a second flange-support rail coupled to the lock-release rod to lie in spaced-apart relation to the first flange-support rail to locate the downwardly opening tab-receiver notches therebetween. The rod coupler also includes a first rocker-glider flange coupled to a free end of the lock rod and arranged to rock and glide on the first flange-support rail during movement of the second panel relative to the first panel. A second rocker-glider flange included in the rod coupler is coupled to a free end of the lock rod and arranged to rock and glide on the second flange support rail during movement of the second panel relative to the first panel. The tab included in the lock rod is positioned to lie between the first and second rocker-glider flanges and extend upwardly toward the overlying downwardly opening tab-receiver notches.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
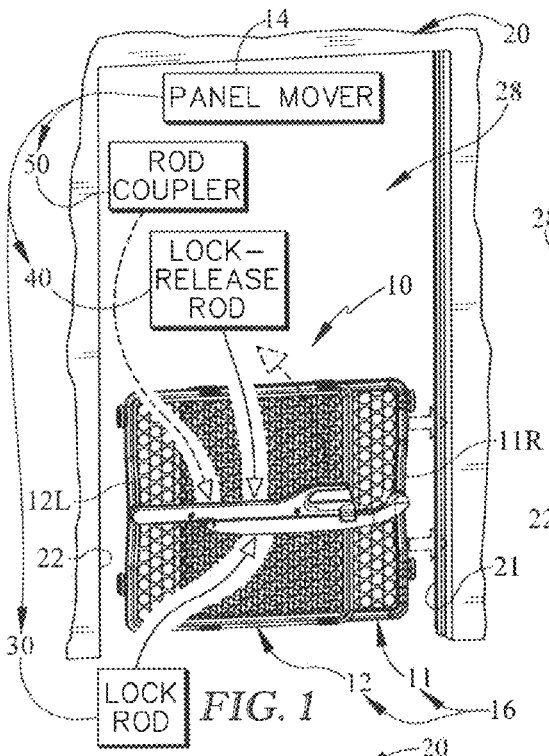
FIG. 1 is a perspective elevation view of an expandable security gate that has been placed in a centered position in a doorway while the gate remains in a contracted-width configuration and showing that the gate includes two panels and a hand-actuated panel mover comprising a pivotable lock rod and a pivotable lock-release rod that is formed to include a handgrip as shown in more detail in FIG. 5.
Figure 2:
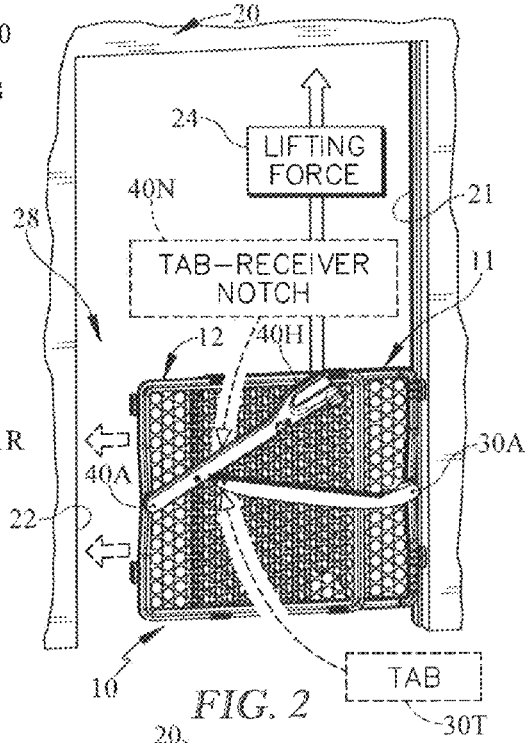
FIG. 2 is a view similar to FIG. 1 showing that a right-side outer edge of a first panel in the gate has been moved to the right to touch a first doorjamb and that a lifting force has been applied to the handgrip included in the lock-release rod to pivot both rods upwardly away from the floor to discharge an upwardly extending tab included in the pivotable lock rod from a downwardly opening first tab-receiver notch formed in the pivotable lock-release rod to free the second panel to be moved to the left relative to the stationary first panel.

A security gate 10 in accordance with the present disclosure can be widened or narrowed in width at the option of a caregiver and pressure-mounted between first and second doorjambs 21, 22 included in a doorway frame 20 using a lockable hand-actuated panel mover 14 as suggested in FIGS. 1-4 and 12-15. A security gate 200 provided with feet 202 in accordance with another embodiment of the present disclosure is shown, for example, in FIG. 16.

Figure 4:
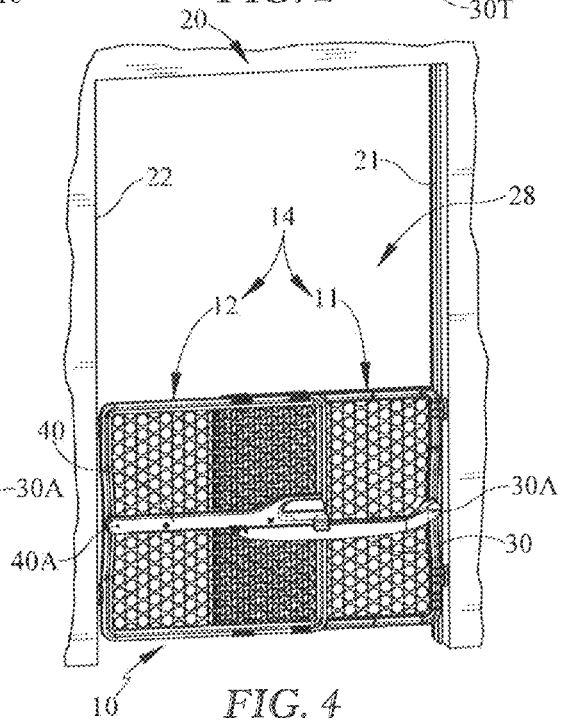
FIG. 4 is a view similar to FIGS. 1-3 suggesting that the tab included in the free end of the lock rod has been moved into a downwardly opening second tab-receiver notch formed in the pivotable lock-release rod to apply panel-spreading forces to the outer edges of the first and second panels to pressure-mount the gate in the doorway securely without hardware.
Figure 5:
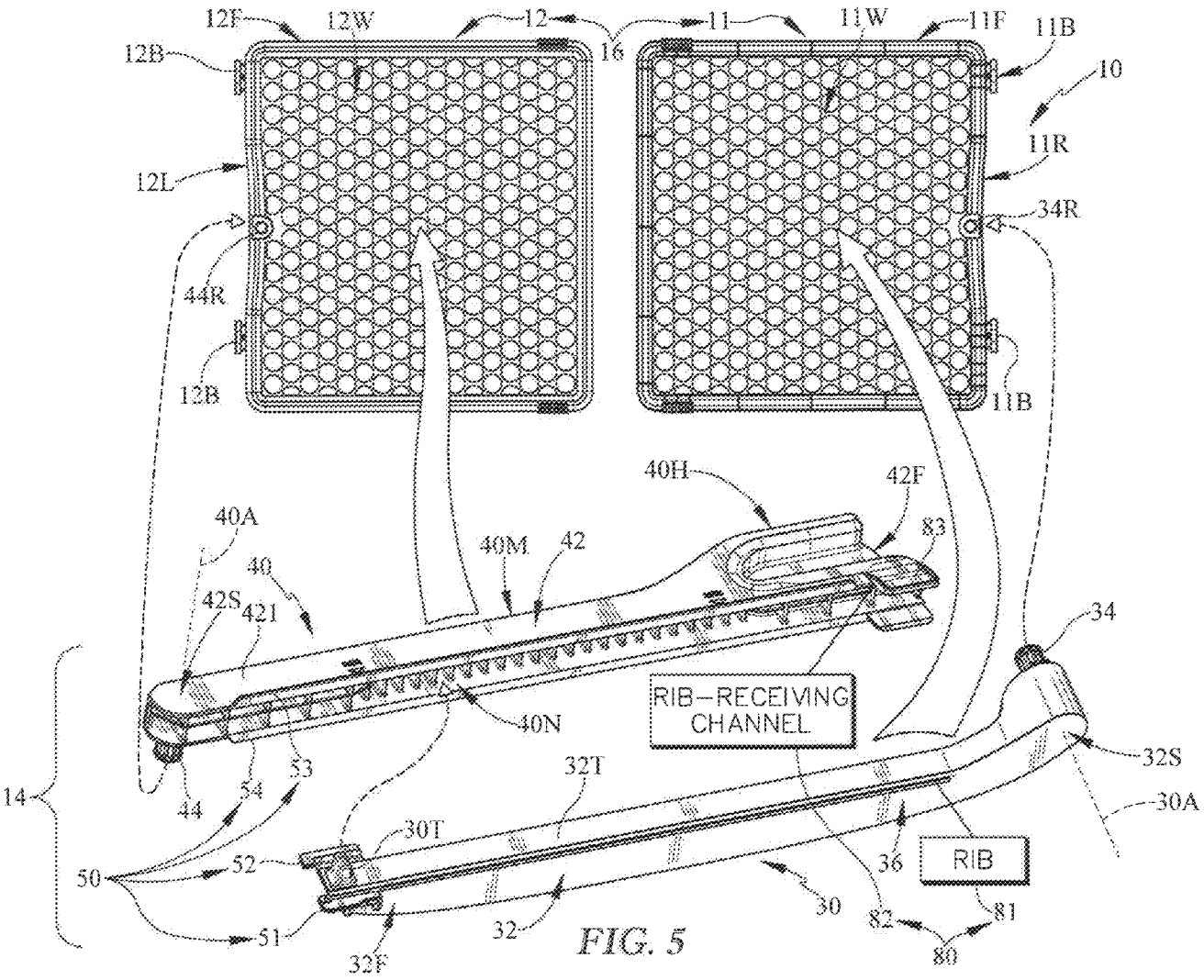
FIG. 5 is an exploded assembly view of components included in the security gate of FIG. 1 showing the first panel (on the right), the second panel (on the left), a lock-release rod including a pivot post arranged on one end of the lock-release rod to extend into a post receiver formed in a left-side outer edge of the second panel, a series of downwardly opening latch-receiver notches, and a handgrip arranged at a free end of the lock-release rod, and a lock rod including a pivot post arranged to extend into a post receiver formed in a right-side outer edge of the first panel and an upwardly extending tab included in the free end of the lock rod and showing that the rod coupler includes (1) cantilevered first and second flange-support rails arranged to lie in spaced-apart relation on the lock-release rod to locate the downwardly opening tab-receiver notches therebetween and (2) cantilevered first and second rocker-glider flanges arranged to lie in spaced-apart relation on the lock rod to locate the upwardly extending tab therebetween.

Security gate 10 includes a first panel 11, a second panel 12 that is movable relative to first panel 11 to provide a variable-width screen 16, and a lockable hand-actuated panel mover 14 that is coupled to first and second panels 11, 12 as shown, for example, in FIGS. 1 and 5. A caregiver can slide second panel 12 relative to first panel 11 to change the width of the variable-width screen 16 established by first and second panels 11, 12 as suggested in FIGS. 1-4, 6, and 12-15. Panels 11, 12 can be drawn together by a caregiver to narrow the width of variable-width screen 16 to allow a caregiver to move security gate 10 into or out of a doorway. Panels 11, 12 can be spread apart by a caregiver to widen the width of variable-width screen 16 so that security gate can be pressure-mounted in a doorway 28 using the lockable hand-actuated panel mover 14 as suggested in FIGS. 2-4.

Figure 3:
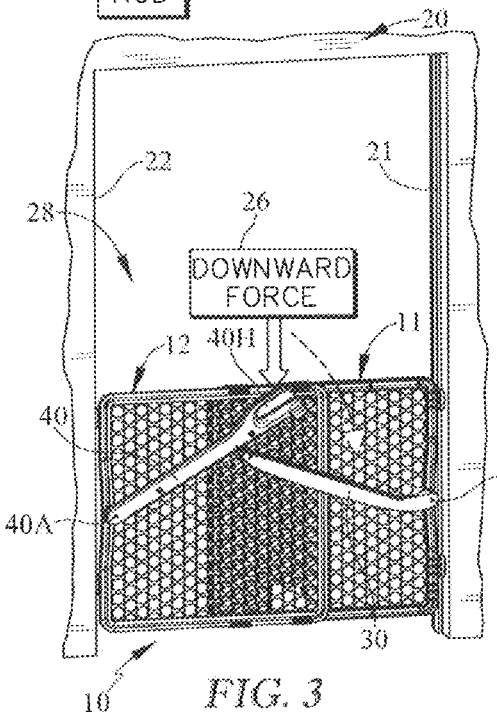
FIG. 3 is a view similar to FIGS. 1 and 2 showing that a left-side outer edge of the second panel has been moved to the left to touch a second doorjamb to reconfigure the gate to assume an expanded-width configuration and suggesting that the gate can be pressure-mounted to the first and second doorjambs by applying a downward force to the handgrip to cause simultaneous counterclockwise pivoting movement of the lock rod and clockwise pivoting movement of the lock-release rod to assume a straightened rigidified shape shown in FIG. 4.

Panel mover 14 is lockable by a caregiver as suggested in FIGS. 3 and 4 and includes a pivotable lock rod 30 coupled to a right-side portion 11R of first panel 11 and a pivotable lock-release rod 40 coupled to a left-side portion 12L of second panel 12 as suggested in FIG. 1. A tab 30T included in pivotable lock rod 30 can be extended upwardly into one of several downwardly opening tab-receiver notches 40N formed in a middle section of pivotable lock-release rod 40 as suggested in FIGS. 2, 5, and 12 to rigidify panel mover 14 and thus block sliding movement of second panel 12 relative to first panel 11 so that a selected width of the variable-width screen 16 is established and security gate 10 is pressure-mounted in a doorway 28 as shown, for example, in FIGS. 4 and 5.

Panels 11, 12 are shown, for example, in FIG. 5. First panel 11 includes a rectangular frame 11F, a web 11W coupled to an inner edge of rectangular frame 11F, and a pair of doorjamb bumpers 11B coupled to an exterior portion of rectangular frame 11F. Doorjamb bumpers 11B are arranged to lie in spaced-apart relation to one another and extend away from web 11W. Right-side portion 11R of first panel 11 includes doorjamb bumpers 11B in an illustrative embodiment. Second panel 12 includes a rectangular frame 12F, a web 12W coupled to an inner edge of rectangular frame 12F, and a pair of doorjamb bumpers 12B coupled to an exterior portion of rectangular frame 12F. Doorjamb bumpers 12B are arranged to lie in spaced-apart relation to one another and extend away from web 12W. Left-side portion 12L of second panel 12 includes doorjamb bumpers 12B in an illustrative embodiment.

Security gate 10 can be installed in a doorway 28 in a manner shown, for example, in FIGS. 1-4. The expandable security gate 10 is placed in a centered position in a doorway 28 formed between first and second doorjambs 21, 22 included in a door frame 20 as shown in FIG. 1. Right-side portion 11R of first panel 11 is moved to the right to touch first doorjamb 21 and a lifting force 24 is applied to a handgrip 40H included in lock-release rod 40 to cause both rods 30, 40 to pivot upwardly away from the underlying floor as suggested in FIG. 2 so that the upwardly extending tab 30T included in the pivotable lock rod 30 is discharged (i.e., withdrawn) from one of the downwardly opening tab-receiver notches 40N formed in the pivotable lock-release rod 40 to free second panel 12 to be moved relative to the stationary first panel 11 to the left toward second doorjamb 22. At this stage, the variable-width screen 16 defined by first and second panels 11, 12 has been widened as shown in FIG. 3 to close the gap provided between first and second doorjambs 21, 22 of door frame 20. Now security gate 10 can be pressure-mounted to door frame 20 once a caregiver applies a downward force 26 to handgrip 40F of the pivotable lock-release rod 40 as suggested in FIG. 3 to cause simultaneous counterclockwise pivoting movement of lock rod 30 and clockwise pivoting movement of lock-release rod 40 to assume a straightened rigidified shape as shown in FIG. 4. At this stage, the upwardly extending tab 30T included in lock rod 30 has been inserted into another of the downwardly opening tab-receiver notches 40N formed in a middle section 40M of lock-release rod 40 to rigidify panel mover 14 and thus block movement of second panel 12 relative to first panel 11 and retain the variable-width screen 16 in a pressure-mounted position in doorway 28 engaging first and second doorjambs 21, 22 of door frame 20.

Figure 7:
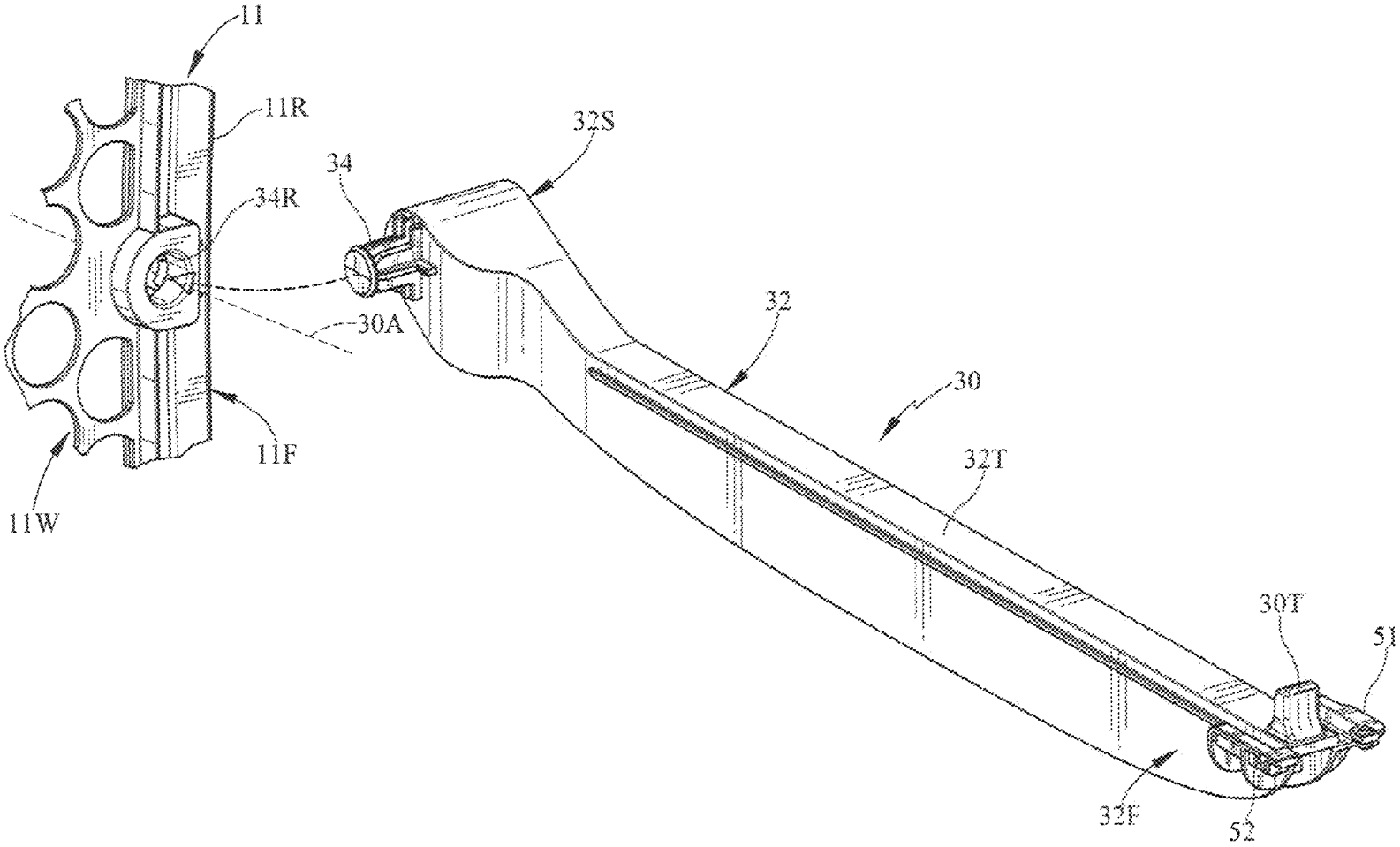
FIG. 7 is an enlarged perspective view of the lock rod before its pivot post is inserted into a post receiver formed in the right-side edge portion of the first panel.
Figure 9:
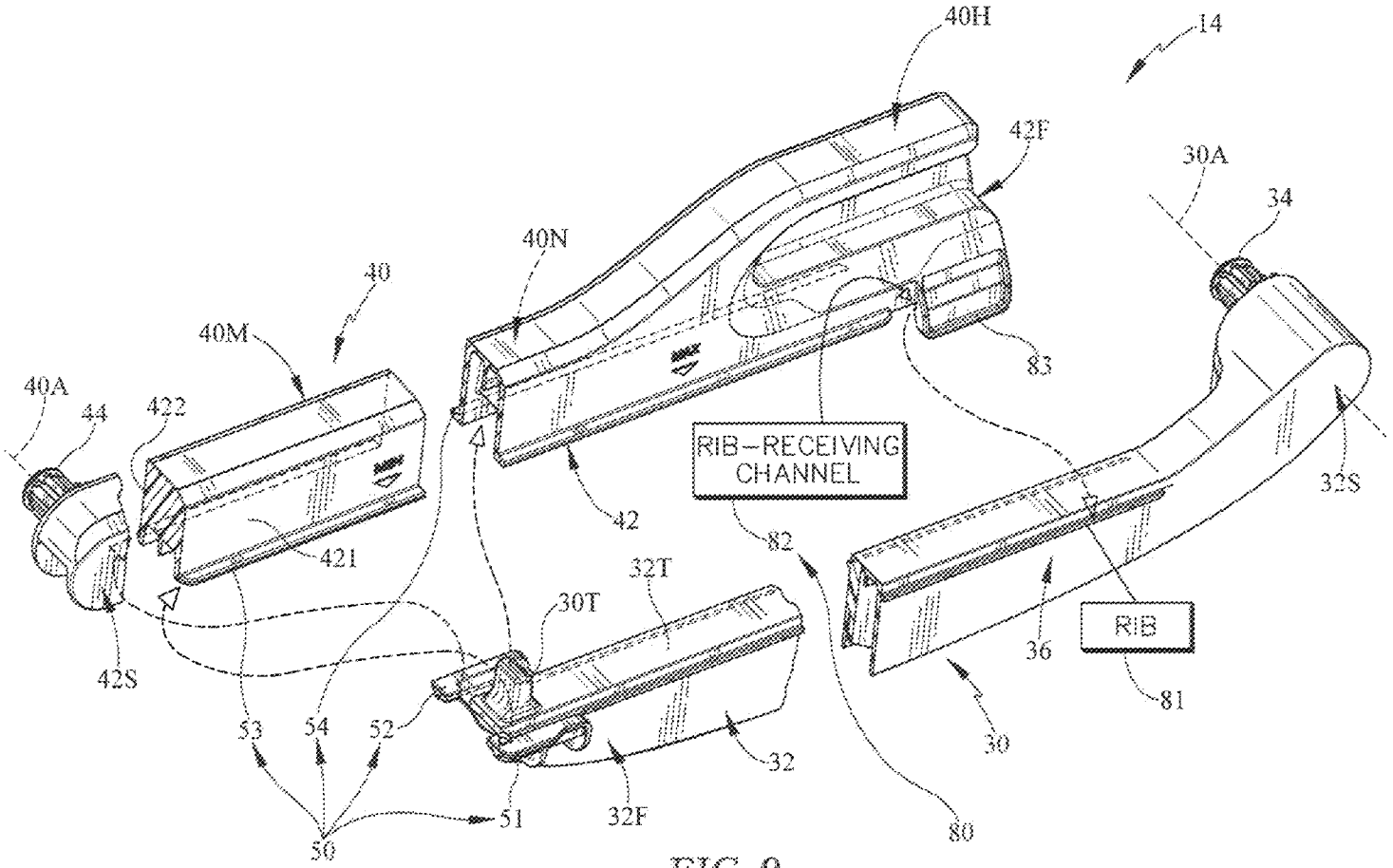
FIG. 9 is a perspective view of each of the lock-release rod and the underlying lock rod (with portions broken away) before mating engagement of the glide flanges included in the rod coupler and coupled to the lock rod and the companion flange-support rails included in the rod coupler and coupled to the lock-release rod to produce a panel mover in accordance with the present disclosure.

Lock rod 30 of panel mover 14 includes a lock arm 32 having a shoulder end 32S and an opposite free end 32F, a lock-rod pivot post 34 coupled to shoulder end 32S, and an upwardly extending tab 30T coupled to free end 32F as shown, for example, in FIGS. 5, 7, and 9. Lock-rod pivot post 34 is arranged to extend into a post receiver 34R formed in right-side portion 11R of first panel 11 as suggested in FIGS. 5 and 7 to support lock arm 32 of lock rod 30 for pivotable movement about first-panel pivot axis 30A as suggested in FIGS. 1-4. Post receiver 34R is formed in frame 11F in an illustrative embodiment.

Figure 8:
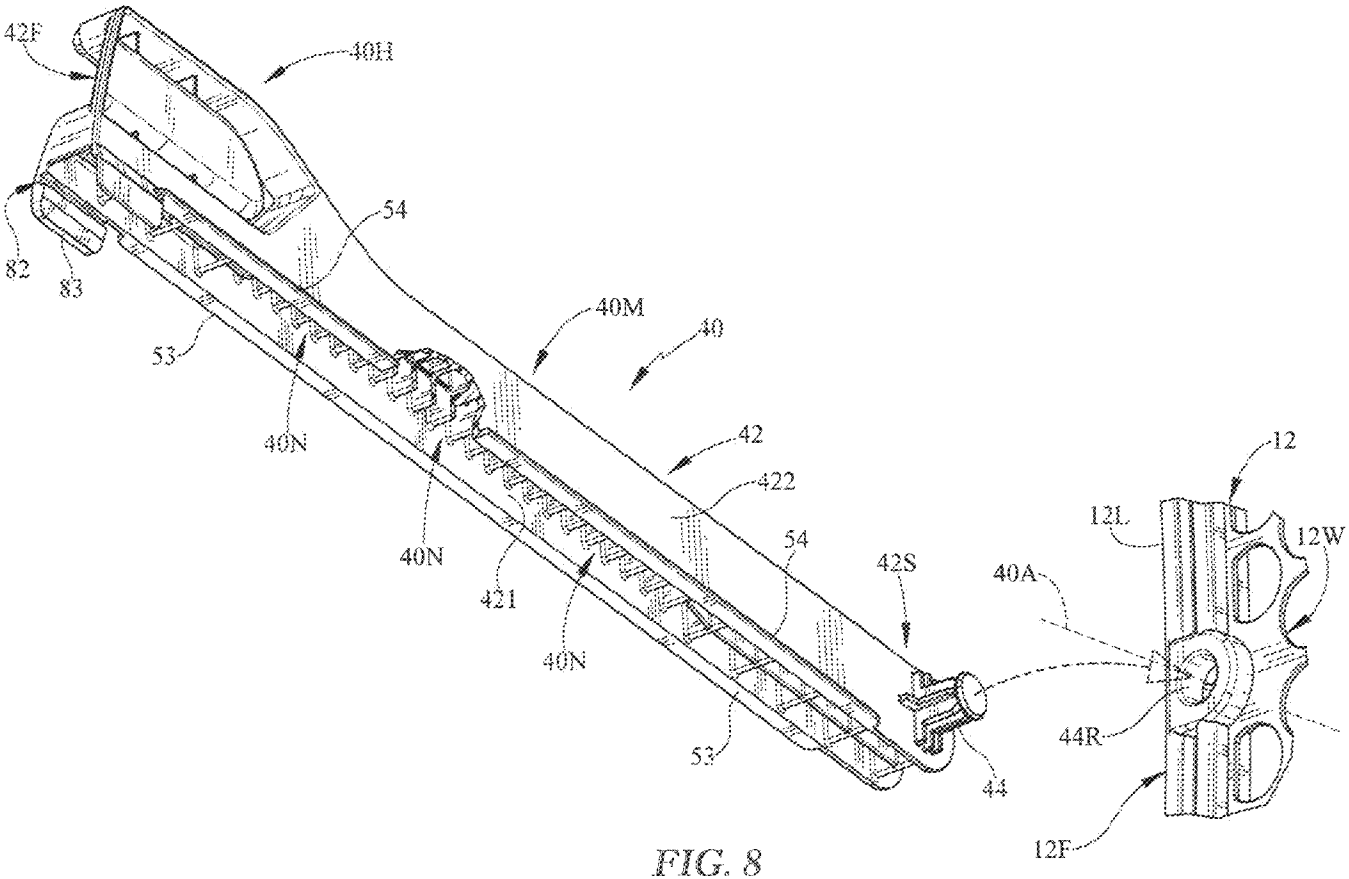
FIG. 8 is an enlarged perspective view of the lock-release rod before its pivot post is inserted into a post receiver formed in the left-side edge portion of the second panel.

Lock-release rod 40 of panel mover 14 includes a release arm 42 having a shoulder end 42S and an opposite free end 42F, a lock-release pivot post 44 coupled to shoulder end 42S, and an upwardly extending handgrip 40H coupled to free end 42F as shown, for example, in FIGS. 5, 8, and 9. Lock-release pivot post 44 is arranged to extend into a post receiver 44R formed in left-side portion 12L of second panel 12 as suggested in FIGS. 5 and 8 to support lock-release arm 42 of lock-release rod 40 for pivotable movement about a second-panel pivot axis 40A as suggested in FIGS. 1-4. Post receiver 44R is formed in frame 12F in an illustrative embodiment.

Panel mover 14 also includes a rod coupler 50 that is configured to tether free end 30F of the pivotable lock rod 30 to move back and forth along a middle portion 40M of lock-release rod 40 during relative movement of first and second panels 11, 12 of variable-width screen 16 to widen or narrow the width of security gate 10 as shown, for example, in FIGS. 1-4. Rod coupler 50 includes short first and second rocker-glider flanges 51, 52 coupled to free end 32F of lock arm 32 of lock rod 30 as shown, for example, in FIGS. 5 and 7 and relatively longer first and second flange-support rails 53, 54 coupled to release arm 42 of lock-release rod 40 and arranged to extend along middle portion 40 of lock-release rod 40 as shown, for example, in FIGS. 5 and 8. The rocker-glider flanges 51, 52 rock and glide on the companion flange-support rails 53, 54 as suggested in FIGS. 12-16 and 12A-16A during pivoting movement of lock rod 30 and lock-release rod 40.

Rocker-glider flanges 51, 52 and flange-support rails 53, 54 of rod coupler 50 are configured to cooperate to provide means for allowing movement of lock-release rod 40 relative to lock rod 30 and for allowing pivoting motion of lock rod 30 about first-panel pivot axis 30A and pivoting motion of lock-release rod 40 about second-panel pivot axis 40A to retain a free end of upwardly extending tab 30T in close proximity to a series of downwardly opening tab-receiver notches 40N formed in middle portion 40M of lock-release rod 40 without allowing movement of tab 30T into opp ne of tab-receiver notches 40N during movement of second panel 12 relative to first panel 11 to widen or narrow the width of variable-width screen 16 and therefore security gate 10 as suggested in FIGS. 12-15.

Rocker-glider flanges 51, 52 of rod coupler 50 are coupled to free end 32F of lock arm 32 of lock rod 30 and arranged to lie in laterally spaced-apart relation to one another to locate the upwardly extending tab 30T of lock rod 30 therebetween as shown in FIGS. 5, 7, and 9. Flange-support rails 53, 54 of rod coupler 50 are coupled to and arranged to extend along middle section 40M of lock-release rod 40 and lie in spaced-apart relation to one another to locate the downwardly opening tab-receiver notches 40N therebetween as shown in FIGS. 5, 8, and 9. The rocker-glider flanges 51, 52 can rock and glide on companion flange-support rails 53, 54 during motion of lock-release rod 40 relative to lock rod 30 as suggested in FIGS. 12-16 and 12A-16A.

Figure 12A:
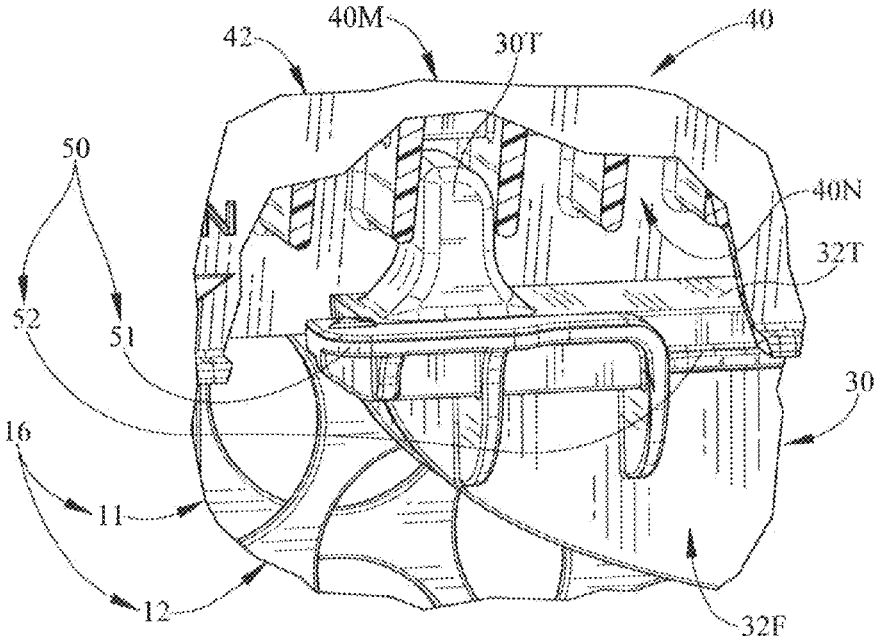
FIG. 12A is an enlarged view of circled region 12A in FIG. 12 showing an upstanding tab included in the pivotable lock rod extending upwardly into a downwardly opening tab-receiver notch formed in the lock-release rod to block sliding movement of the second panel relative to the first panel.
Figure 12:
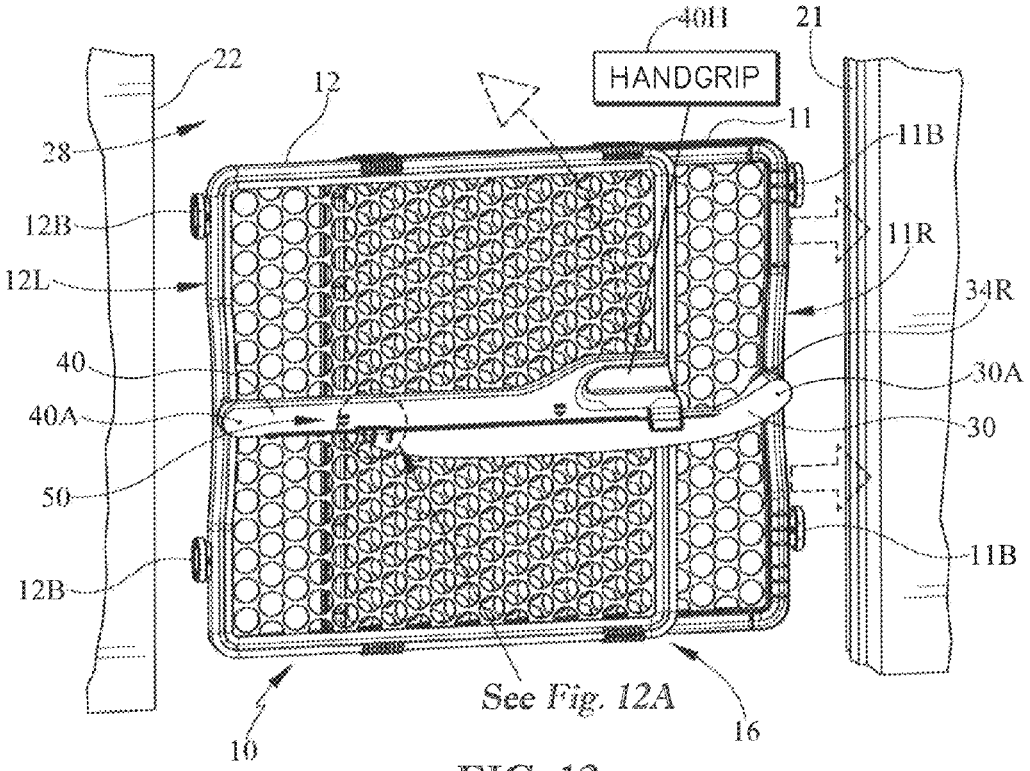
FIG. 12 is an enlarged view of the gate shown in FIG. 1 before the gate is expanded and pressure-mounted in a doorway using the hand-actuated panel mover.

Operation of panel mover 14 and expansion of variable-width screen 14 to fill a doorway 28 is shown, for example, in FIGS. 12-16 and FIGS. 12A-16A. An expandable security gate 10 is placed in a centered position in a doorway 28 while the gate 10 remains in a contracted-width configuration as shown in FIG. 12. Gate 10 includes two panels 11, 12 and a hand-actuated panel mover 14 comprising a pivotable lock rod 30 and a pivotable lock-release rod 40 that is formed to include a handgrip 40H as shown in more detail in FIG. 5.

Figure 13A:
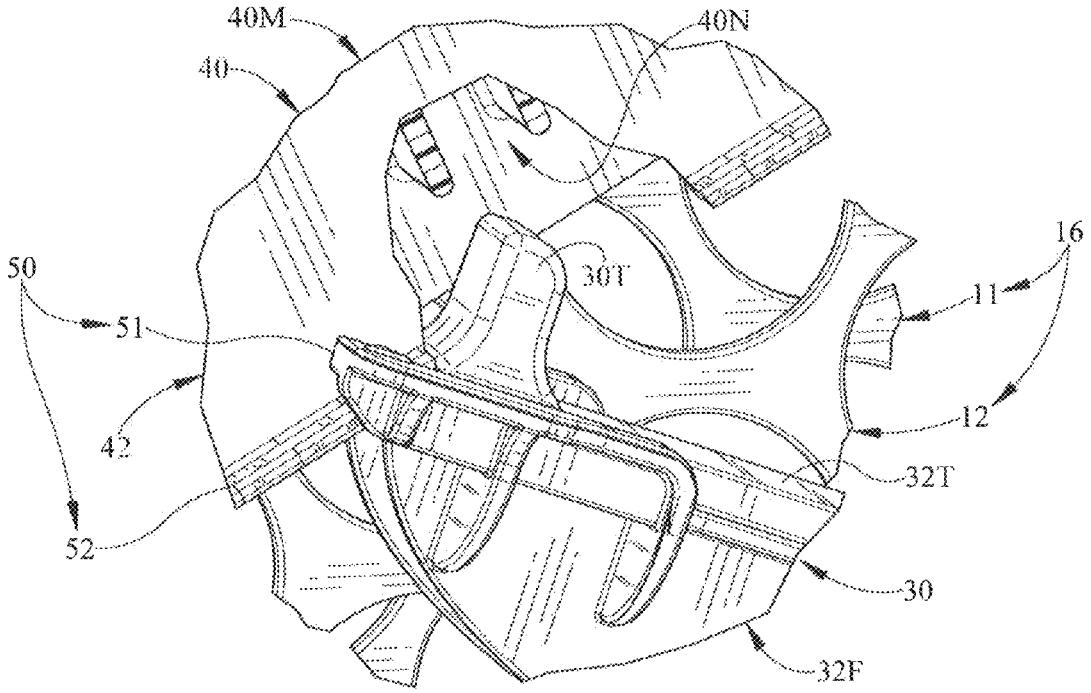
FIG. 13A is an enlarged view of the circled region 13A in FIG. 13 showing that the tab has been withdrawn from the overlying tab-receiver notch following pivoting movement of each of the lock-release rod and the lock rod.
Figure 13:
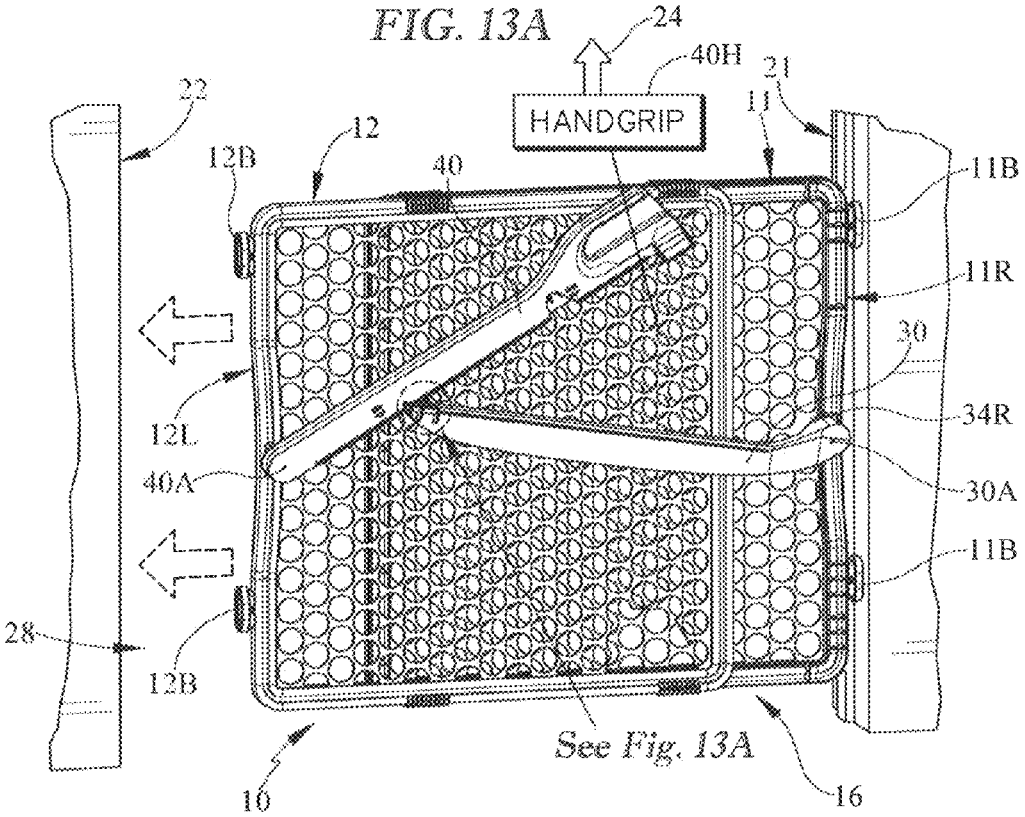
FIG. 13 is a view similar to FIG. 12 after the first panel is moved to contact the first doorjamb and the handgrip of the lock-release rod is lifted to cause both rods to pivot upwardly.

A right-side portion 11R of a first panel 11 in gate 10 has been moved to the right to touch a first doorjamb 21 as suggested in FIG. 13. A lifting force 24 is applied to handgrip 40H included in lock-release rod 40 to pivot both rods 30, 40 upwardly away from the underlying floor to discharge an upwardly extending tab 30T included in pivotable lock rod 30 from a downwardly opening first tab-receiver notch 40N formed in pivotable lock-release rod 40 to free second panel 12 to be moved to the left relative to the stationary first panel 11 as suggested in FIG. 13.

Figure 14A:
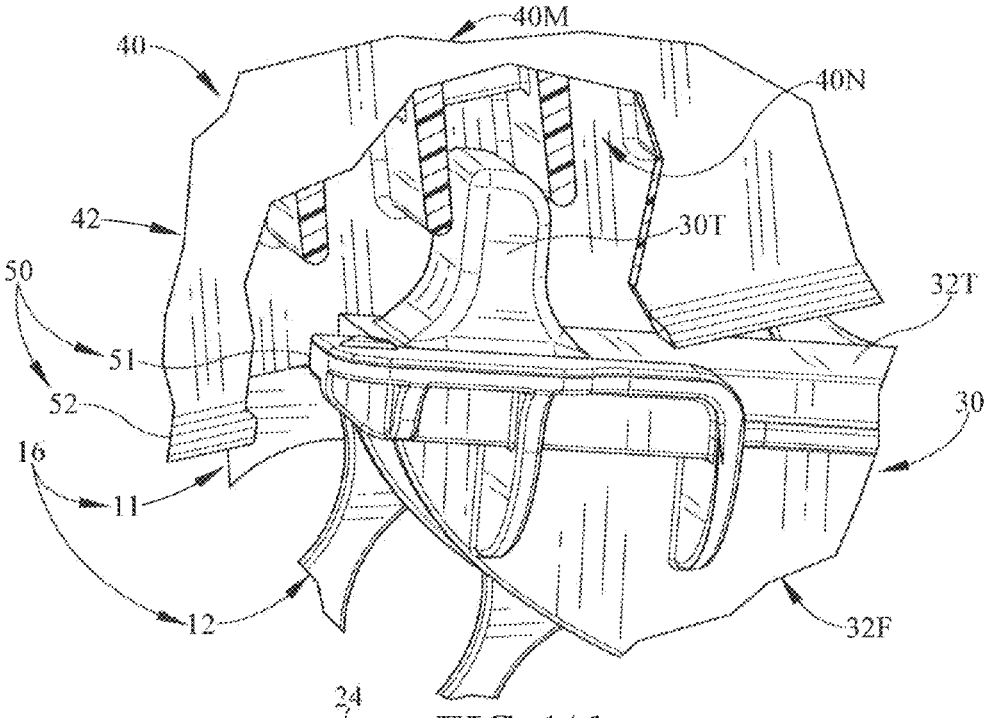
FIG. 14A is an enlarged view of the circled region in FIG. 14.
Figure 14:
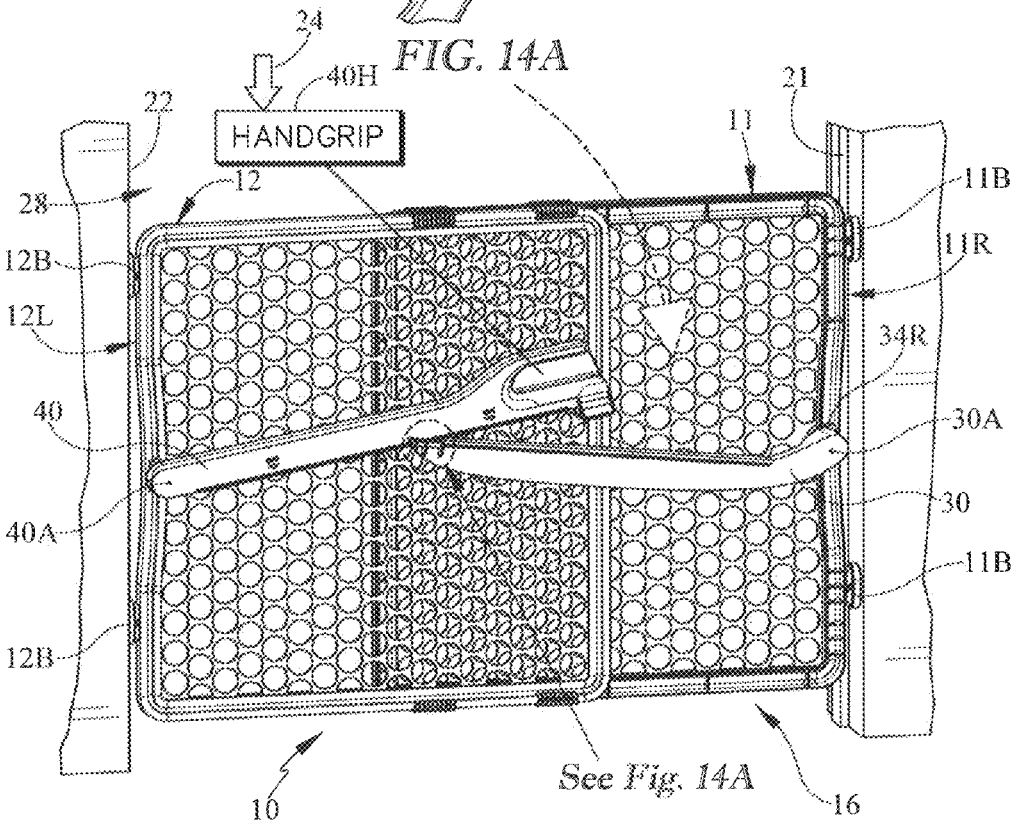
FIG. 14 is a view similar to FIGS. 12 and 13 after the second panel is slid relative to the first panel to contact the second doorjamb.

A left-side portion 11L of second panel 12 has been moved to the left to touch a second doorjamb 22 as suggested in FIG. 14 to expand variable-width screen 16 and to reconfigure gate 10 to assume an expanded-width configuration. Gate 10 can be pressure-mounted to the first and second doorjambs 21, 22 by applying a downward force 26 to handgrip 40H to cause simultaneous counterclockwise pivoting movement of lock rod 30 and clockwise pivoting movement of lock-release rod 40 to assume a straightened rigidified shape as suggested in FIG. 15. The upwardly extending tab 30T included in lock rod 30 has been moved into a downwardly opening second tab-receiver notch 40N formed in the pivotable lock-release rod 40 to apply panel-spreading forces to the outer edges of the first and second panels 11, 12 to pressure-mount the gate 10 in the doorway 28 securely without hardware.

An exploded assembly view of components included in the security gate 10 is provided in FIG. 5 and shows the first panel 11 (on the right), the second panel 12 (on the left), a lock-release rod 40, and a lock rod 30. Lock-release rod 40 includes a release arm 42, a lock-release pivot post 44 arranged on one end of the release arm 42 to extend into a post receiver 44R formed in a left-side portion of the second panel 12, a series of downwardly opening tab-receiver notches 40N, and a handgrip 40H arranged at a free end of release arm 42 as shown, for example, in FIG. 5. Lock rod 30 includes a lock arm 32, a lock pivot post 34 arranged to extend into a post receiver 34R formed in a right-side portion 11R of first panel 11, and an upwardly extending tab 30T coupled to a free end 32F of the lock arm 32 of the lock rod 30. The rod coupler 50 is shown in FIG. 5 to includes (1) cantilevered first and second flange-support rails 53, 54 arranged to lie in spaced-apart relation on release arm 42 of lock-release rod 40 to locate the downwardly opening tab-receiver notches 40N therebetween and (2) cantilevered first and second rocker-glider flanges 51, 52 arranged to lie in spaced-apart relation on lock arm 32 of lock rod 30 to locate the upwardly extending tab 30T therebetween.

Figure 10B:
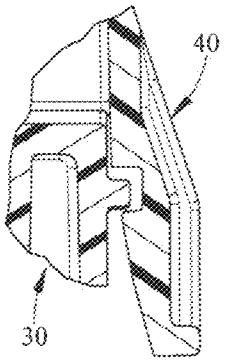
FIG. 10B is a sectional view taken along line 10B-10B showing a handgrip retainer comprising a rib coupled to the lock rod arranged to extend into a rib-receiving channel formed in a downwardly extending plate to retain a free end of the lock-release rod in mating engagement with a portion of the underlying lock rod.
Figure 10:
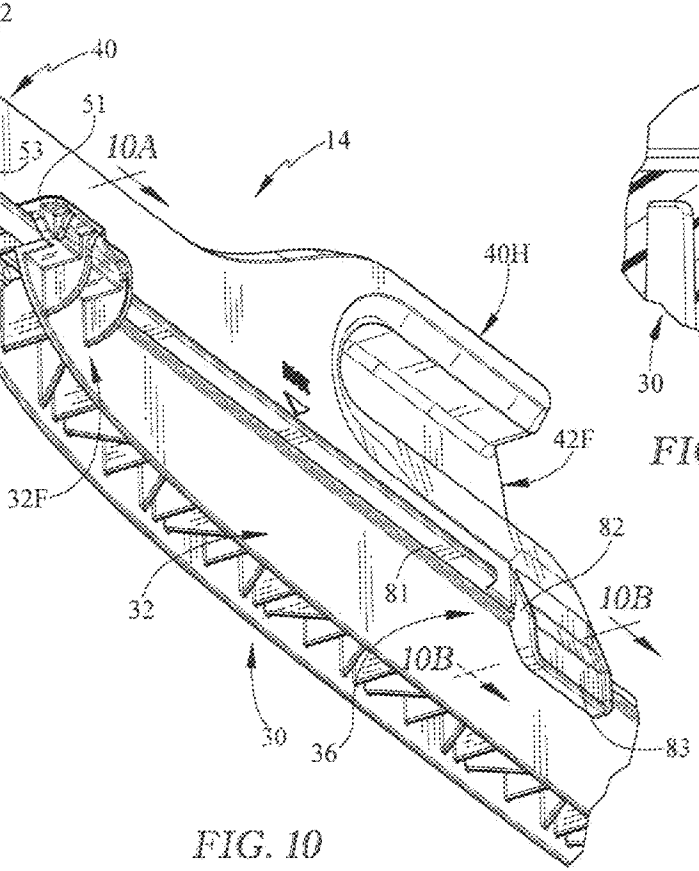
FIG. 10 is a perspective view of a portion of the panel mover of FIG. 9 when the panel mover is rigidified as shown in FIG. 4.
Figure 10A:
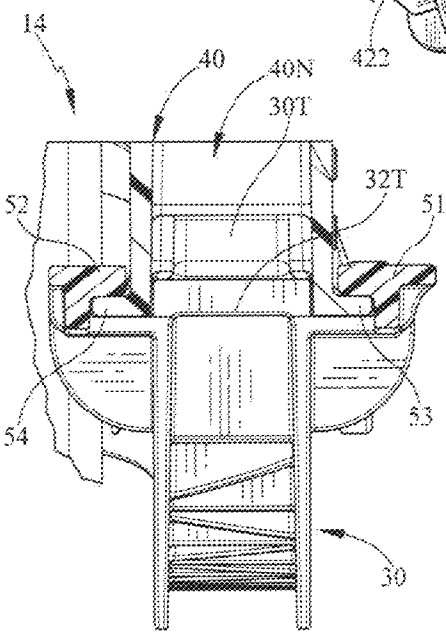
FIG. 10A is a sectional view taken along lines 10A-10A of FIG. 10 showing mating engagement (on the right) of the first rocker-glider flange that is coupled to the lock rod and the underlying first flange-support rail that is coupled to the lock-release rod and showing mating engagement (on the left) of the second rocker-glider flange that is coupled to the lock rod and the underlying second flange-support rail that is coupled to the lock-release rod.

Lock arm 32 of pivotable lock rod 30 includes a top wall 32T that is arranged to face upwardly toward the generally downwardly opening tab-receiver notches 40N as suggested in FIGS. 5, 9, and 10A. Tab-receiver notches 40N open downwardly toward the floor underlying variable-width screen 16 as suggested in FIGS. 1-4 and 5. Tab 30T of the pivotable lock rod 30 is coupled to top wall 32T of lock arm 32 and arranged to lie between first and second rocker-glider flanges 51, 52 of rod coupler 50 as suggested in FIGS. 5 and 7.

Release arm 42 of pivotable lock-release rod 40 includes a first side wall 421 arranged to face away from variable-width section 16 and a second side wall 422 arranged to face toward variable-width section 16 as suggested in FIGS. 5, 8, and 9. Second side wall 422 is arranged to lie in spaced-apart relation to first side wall 421 to locate the downwardly opening tab-receiver notches 40N therebetween. First flange-support rail 53 is cantilevered to first side wall 421 and arranged to extend in a first direction away from tab-receiver notches 40N. Second flange-support rail 54 is cantilevered to second side wall 422 and arranged to extend in an opposite second direction away from the tab-receiver notches 40N and toward variable-width screen 16.

Figure 6:
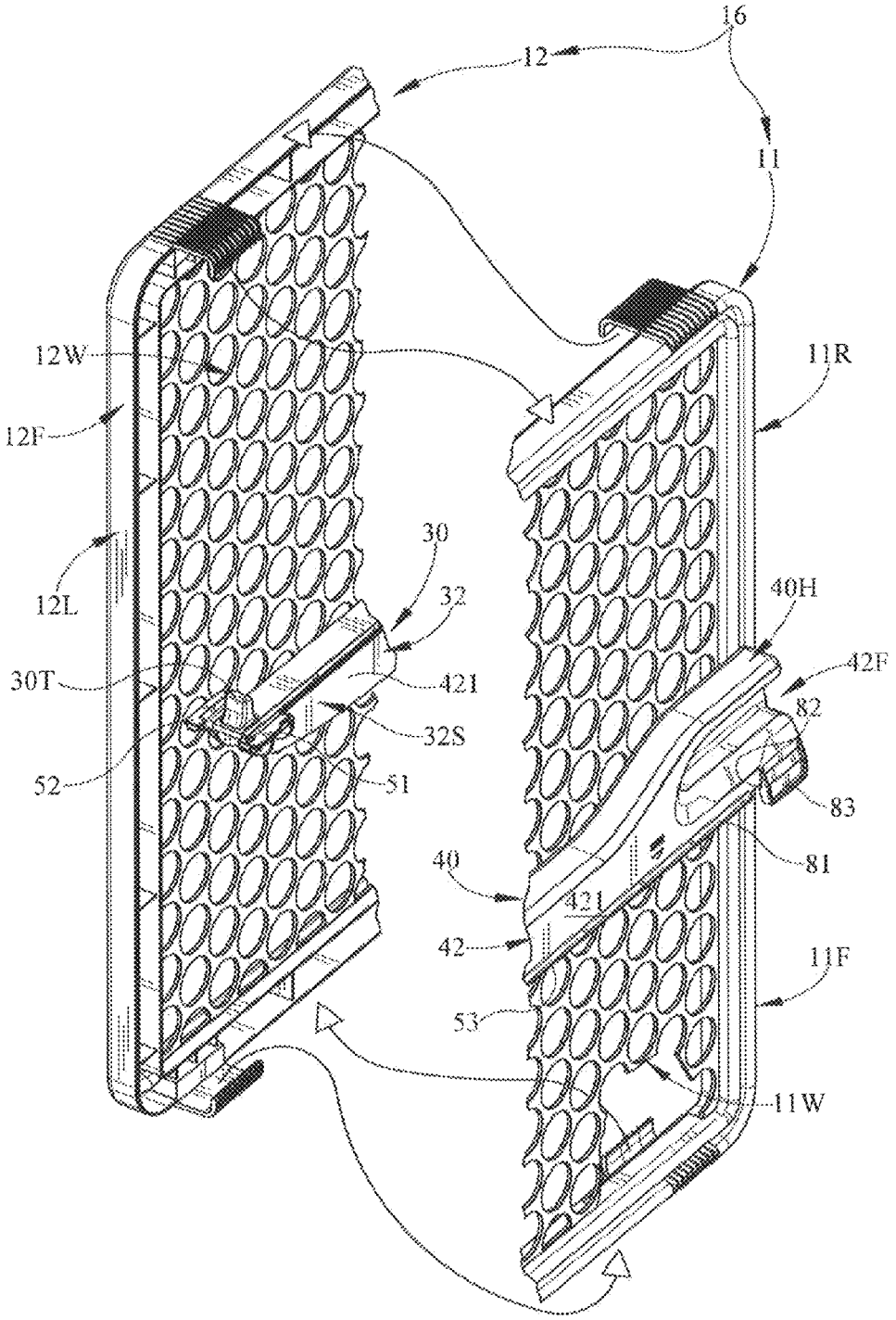
FIG. 6 is a perspective view showing portions of the first and second panels before they are mated to allow the second panel to slide relative to the first panel to produce a variable-width screen.

Portions of the first and second panels 11, 12 are shown in FIG. 6 before they are mated to allow second panel 12 to slide relative to first panel 11 to produce a variable-width screen 16. The lock rod 30 is shown in FIG. 7 before its pivot post 34 is inserted into a post receiver 34R formed in the right-side portion 11R of first panel 11. The lock-release rod 40 is shown in FIG. 8 before its pivot post 44 is inserted into a post receiver 44R formed in the left-side portion 12L of second panel 12.

Figure 11:
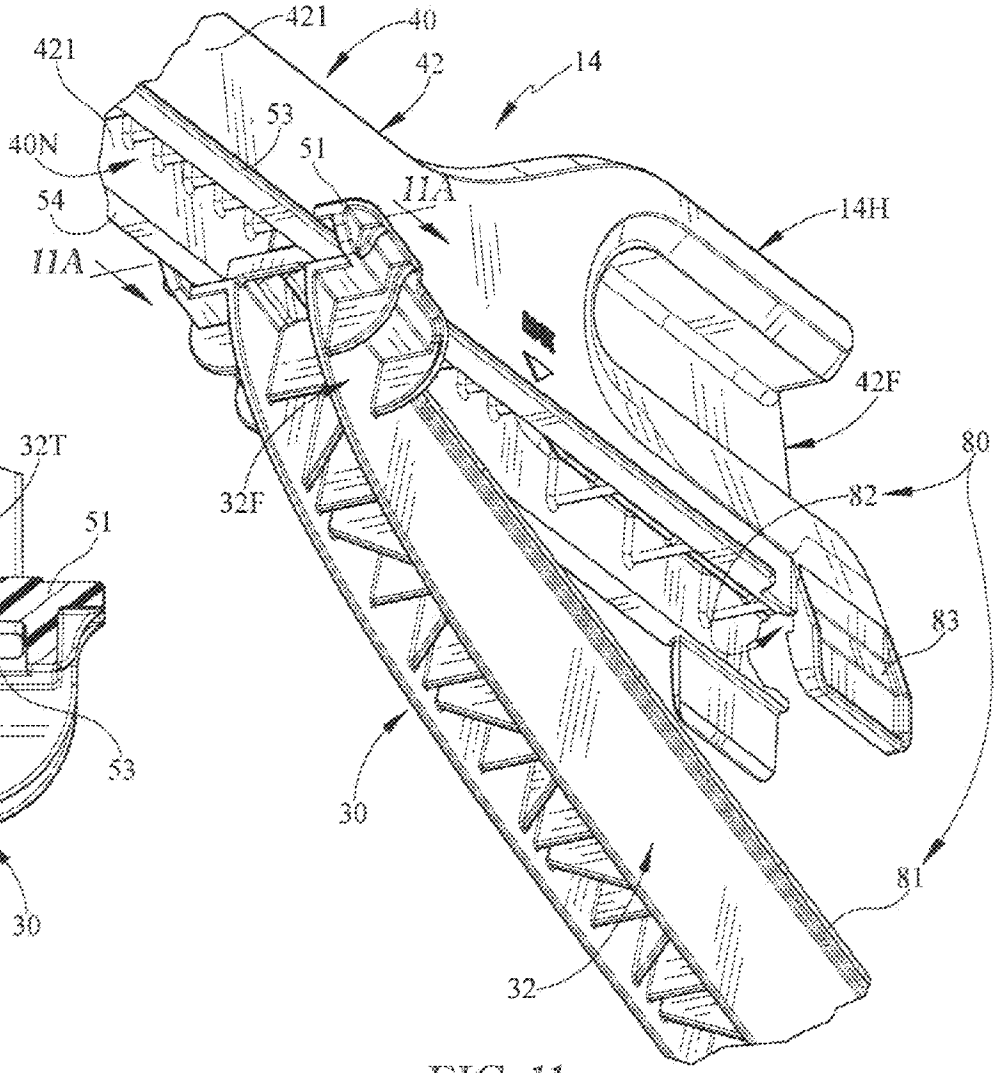
FIG. 11 is a perspective view of a portion of the panel mover when the panel mover is configured as shown in FIG. 14 with a portion broken away to show the rib-receiving channel formed in the lock-release rod.
Figure 11A:
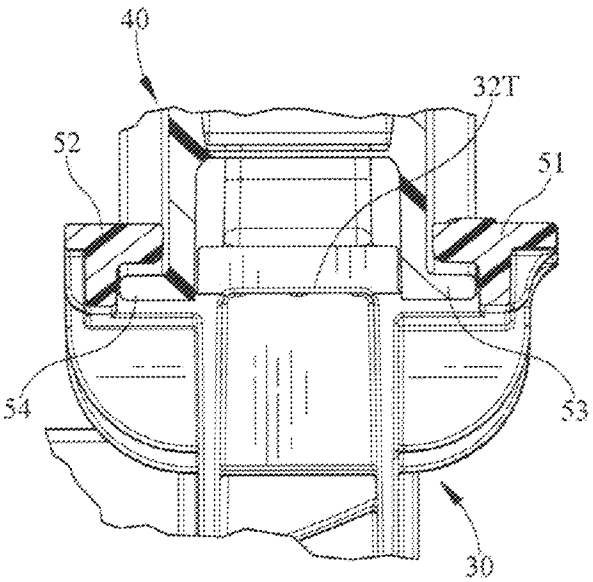
FIG. 11A is a sectional view taken along lines 11A-11A of FIG. 11.

Each of the lock-release rod 40 and the underlying lock rod 30 are shown in FIG. 9 before mating engagement of the rocker-glider flanges 51, 52 included in rod coupler 50 and coupled to lock rod 30 and the companion flange-support rails 53, 54 included in rod coupler 50 and coupled to lock-release rod 40 to produce a panel mover 14 in accordance with the present disclosure. Mating engagement (on the right) of the first rocker-glider flange 51 that is coupled to lock rod 30 and the underlying first flange-support rail 53 that is coupled to lock-release rod 40 and mating engagement (on the left) of the second rocker-glider flange 52 that is coupled to lock rod 30 and the underlying second flange-support rail 54 that is coupled to lock-release rod 40 is shown in FIG. 10A. A handgrip retainer 80 comprising a rib 81 coupled to lock rod 30 arranged to extend into a rib-receiving channel 82 formed in a downwardly extending plate 83 to retain a free end 42F of the lock-release rod 40 in mating engagement with a portion 36 of the underlying lock rod 30 is shown in FIG. 10B to block drift of free end 42F of lock-release rod 40 relative to lock rod 30 until the handgrip 40H is lifted as suggested in FIGS. 2 and 13 to actuate panel mover 14. FIG. 11 is a perspective view of a portion of panel mover 14 when panel mover 14 is configured as shown in FIG. 14 with a portion broken away to show the rib-receiving channel 82 formed in lock-release rod 40.

An enlarged view of gate 10 shown in FIG. 1 before gate 10 is expanded and pressure-mounted in a doorway 28 using hand-actuated panel mover 14 is shown in FIG. 12. An upstanding tab 30T included in pivotable lock rod 30 is arranged to extend upwardly into a downwardly opening tab-receiver notch 40N formed in lock-release rod 40 to block sliding movement of second panel 12 relative to first panel 11 as shown in FIG. 12A.

The first panel 11 is moved to contact first doorjamb 21 and handgrip 40H of lock-release rod 40 is lifted to cause both rods 30, 40 to pivot upwardly as shown in FIG. 13. The tab 30T has been withdrawn from the overlying tab-receiver notch 40N following pivoting movement of each of lock-release rod 40 and lock rod 30 as shown in FIG. 13A. Then the second panel 12 is slid relative to first panel 11 to contact second doorjamb 22.

Figure 15A:
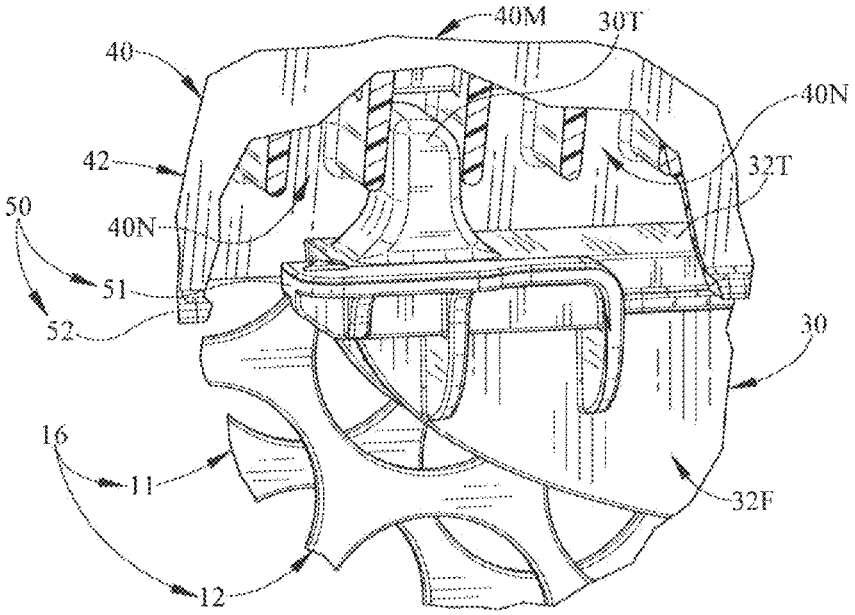
FIG. 15A is an enlarged view of the circled region in FIG. 15.
Figure 15:
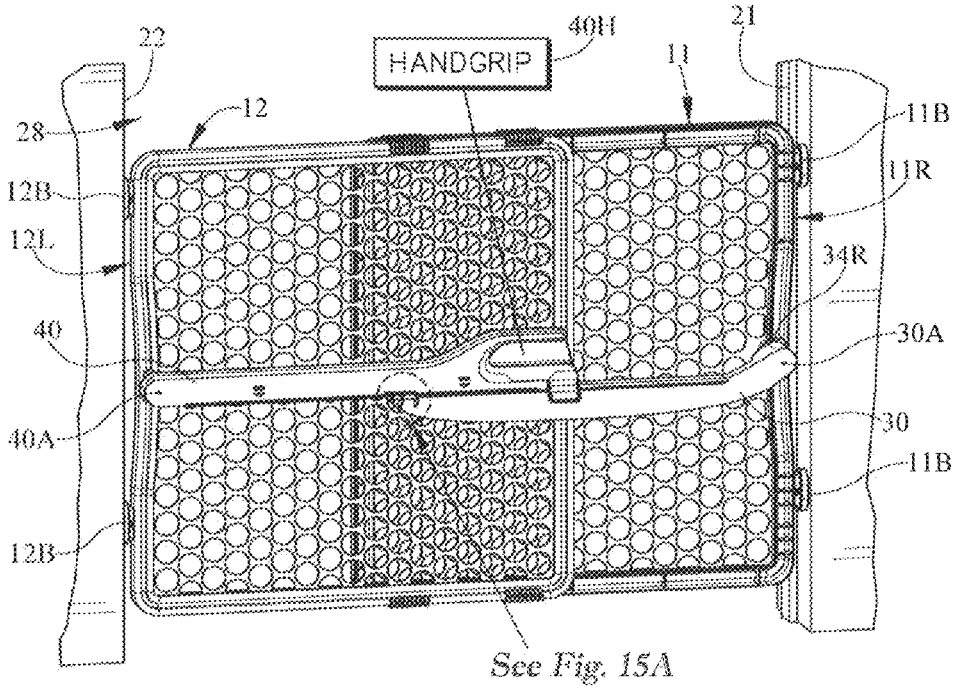
FIG. 15 is a view similar to FIGS. 12-14 after the handgrip has been pushed in a downward direction to mate the free end of the lock-release rod and a middle portion of the underlying lock rod to rigidify the panel mover and cause further relative movement of the first and second panels to pressure-mount the first panel to the first doorjamb and the second panel to the second doorjamb.
Figure 16:
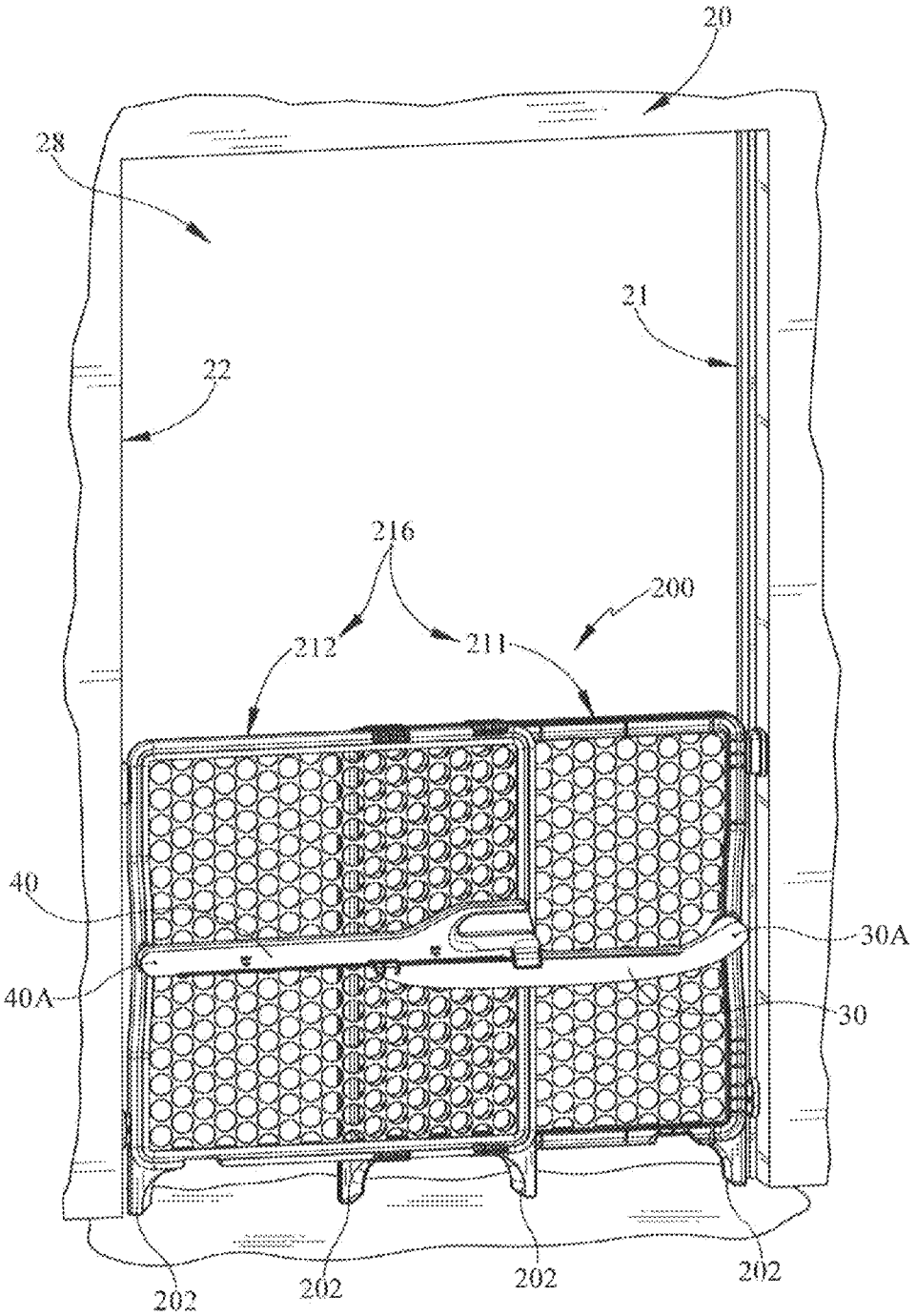
FIG. 16 is a perspective view of an expandable security gate in accordance with another embodiment of the present disclosure showing that two feet are coupled to a bottom portion of each of the first and second panels.

Security gate 10 is installed as shown in FIG. 15 after handgrip 40H has been pushed in a downward direction to mate the free end 42F of lock-release rod 40 and a middle portion of the underlying lock rod 30 to rigidify panel mover 14 and cause further relative movement of first and second panels 11, 12 to pressure-mount first panel 11 to first doorjamb 21 and second panel 12 to second doorjamb 22.

In illustrative embodiments, security gate 10 is made only of components made of plastics materials. Security gate 10 is a lightweight and low-cost item in which tab-receiver notches 40N are formed in the upper rod 40 to open downwardly toward an upwardly extending tab 30T included in the lower rod 30. Thus the tab-receiver notches 40N are concealed and open downwardly toward the ground underlying security gate 10 and toward the underlying lock rod 30.

The invention claimed is:

1. A security gate comprising a variable-width screen including a first panel adapted to lie in a doorway and mate with a first doorjamb bordering the doorway and a second panel mounted on the first panel for sliding movement relative to the first panel to mate with an opposing second doorjamb bordering the doorway to widen a width of the variable-width screen to abut the first and second doorjambs and span the doorway between the first and second doorjambs and, alternatively, to separate from the opposing second doorjamb to narrow the width of the variable-width screen to allow a caregiver to move the variable-width screen into or out of the doorway, and a hand-operated panel mover including a pivotable lock rod mounted on the first panel for pivotable movement about a first-panel pivot axis and a pivotable lock-release rod mounted on the second panel for pivotable movement about a second-panel pivot axis to engage and disengage the pivotable lock rod at the option of a caregiver, wherein the pivotable lock-release rod is formed to include a series of separate tab-receiver notches and the pivotable lock rod is formed to include a tab sized to fit into any of the tab-receiver notches formed in the pivotable lock-release rod when the pivotable lock-release rod and the pivotable lock rod are arranged to lie in side-by-side relation to one another to establish a panel-locking mode of the hand-operated panel mover so as to anchor the pivotable lock-release rod to the pivotable lock rod to apply panel-spreading forces to outer edges of the first and second panels to pressure-mount outer edges of the first and second panels of the variable-width screen to the first and second doorjambs bordering the doorway, and wherein the hand-operated panel mover further includes a rod coupler coupled to each of the pivotable lock-release rod and the pivotable lock rod and configured to provide means for tethering a free end of the pivotable lock rod to move back and forth along the pivotable lock-release rod to retain a free end of the tab included in the lock rod in close proximity to the series of tab-receiver notches formed in the lock-release rod without allowing movement of the tab into one of the tab-receiver notches during movement of the second panel relative to the first panel to widen or narrow the width of the variable-width screen after pivoting movement of the lock-release rod about the second-panel pivot axis away from a floor underlying the variable-width screen and away from a side-by-side relation with the pivotable lock rod to establish an obtuse included angle therebetween opening downwardly toward the floor during pivoting movement of the lock rod about the first-panel pivot axis away from the floor.

2. The security gate of claim 1, wherein the pivotable lock-release rod includes a release arm, a lock-release pivot post arranged on a first end of the release arm to extend into a post receiver formed in a left-side portion of the second panel, and a handgrip arranged on an opposite second end of the release arm, a portion of the release arm located between the lock-release pivot post and the handgrip is formed to include the tab-receiver notches, the pivotable lock rod includes a lock arm and a lock pivot post arranged to extend into a post receiver formed in a right-side portion of the first panel, and the tab is coupled to a free end of the lock arm and arranged to extend upwardly in a direction toward the tab-receiver notches.

3. The security gate of claim 2, wherein the rod coupler is coupled to the lock-release arm and to the lock arm.

4. The security gate of claim 3, wherein the rod coupler is coupled to the free end of the lock arm and is arranged to extend along an elongated portion of the lock-release arm extending from the lock-release pivot post to the handgrip.

5. The security gate of claim 4, wherein the rod coupler includes a flange-support rail coupled to the elongated portion of the lock-release arm and a rocker-glider flange coupled to the free end of the lock arm and arranged to rock and glide along the flange-support rail during pivoting movement of the pivotable lock-release rod about the second-panel pivot axis to cause pivoting movement of the pivotable lock rod about the first-panel pivot axis and to cause relative movement of the second panel relative to the first panel to change the width of the variable-width screen.

6. The security gate of claim 2, wherein the rod coupler includes cantilevered first and second flange-support rails arranged to lie in spaced-apart relation on the release arm of the pivotable lock-release rod to locate the tab-receiver notches therebetween and cantilevered first and second rocker-glider flanges arranged to lie in spaced-apart relation on the lock arm of the pivotable lock rod to locate the tab therebetween, the first rocker-glider flange is arranged to lie in mating engagement to the first flange-support rail to rock and glide back and forth thereon during movement of the first panel relative to the second panel after separation of the tab on the lock arm from the tab-receiver notches in the release arm, and the second rocker-glider flange is arranged to lie in mating engagement to the second flange-support rail to the second flange-support rail to rock and glide back and forth thereon during movement of the first panel relative to the second panel after separation of the tab on the lock arm from the tab-receiver notches in the release arm.

7. The security gate of claim 6, wherein the lock arm includes a top wall arranged to face upwardly toward the tab-receiver notches that open downwardly toward the floor underlying the variable-width screen and the tab is coupled to the top wall and arranged to lie between the first and second rocker-glider flanges.

8. The security gate of claim 6, wherein the release arm includes a first side wall arranged to face away from the variable-width section and a second side wall arranged to face toward the variable-width section and to lie in spaced-apart relation to the first side wall to locate the tab-receiver notches therebetween, the first flange-support rail is cantilevered to the first side wall and arranged to extend in a first direction away from the tab-receiver notches and from the variable-width screen, and the second flange-support rail is cantilevered to the second side wall and arranged to extend in an opposite second direction away from the tab-receiver notches and toward the variable-width screen.

9. The security gate of claim 2, wherein the handgrip is configured to receive a lifting force applied by a caregiver to cause counterclockwise pivoting movement of the pivotable lock-release rod and simultaneous clockwise pivoting movement of the pivotable lock rod relative to the variable-width screen to pivot each of the pivotable lock-release rod and the pivotable lock rod upwardly away from the underlying floor so that the tab is discharged from one of the tab-receiver notches formed in the release arm of the pivotable lock-release rod to free the second panel to be moved by the caregiver relative to the first panel to widen or narrow the width of the variable-width screen and for receiving a downward force applied by the caregiver to cause simultaneous counterclockwise pivoting movement of the pivotable lock rod and clockwise pivoting movement of the pivotable lock-release rod to assume a straightened rigidified shape wherein the pivotable lock-release rod and the pivotable lock rod are arranged to lie in side-by-side relation to one another to cause the tab of the pivotable lock rod to extend into one of the tab-receiver notches of the pivotable lock-release rod to rigidify the hand-operated panel mover and thus block movement of the second panel relative to the first panel and fix the width of the variable-width screen.

10. The security gate of claim 1, wherein the pivotable lock rod includes a lock arm having a shoulder end and an opposite free end, a lock-rod pivot post coupled to the shoulder end, and the tab is coupled to the free end and arranged to extend upwardly toward the tab-receiver notches formed in the pivotable lock-release rod, and the lock-rod pivot is arranged to extend into a post receiver formed in a right-side portion of the first panel to support the lock arm for pivotable movement about the first-panel pivot axis.

11. The security gate of claim 10, wherein the rod coupler includes first and second flange-support rails coupled to the pivotable lock-release rod, a first rocker-glider flange coupled to the free end of the lock arm and arranged to rock and glide on the first flange-support rail during movement of the second panel relative to the first panel, and a second rocker-glider flange coupled to the free end of the lock arm and arranged to rock and glide on the second flange-support rail during motion of the pivotable lock-release rod relative to the pivotable lock rod and during movement of the second panel relative to the first panel.

12. The security gate of claim 11, wherein the first and second flange-support rails are arranged to lie in spaced-apart relation to one another to locate the tab-receiver notches therebetween.

13. The security gate of claim 11, wherein the pivotable lock-release rod includes a release arm having a shoulder end and an opposite free end, a lock-release pivot post coupled to the shoulder end, and an upwardly extending handgrip coupled to the free end of the release arm, the release arm is formed to include the tab-receiver notches, the lock-release pivot post is arranged to extend into a post receiver formed in a left-side portion of the second panel to support the pivotable lock-release rod for pivotable movement about the second-panel pivot axis, and the first and second flange-support rails are coupled to the release arm and arranged to extend from the lock-release pivot post to the free end of the release arm.

14. The security gate of claim 10, wherein the pivotable lock-release rod includes a release arm having a shoulder end and an opposite free end, a lock-release pivot post coupled to the shoulder end, and an upwardly extending handgrip coupled to the free end of the release arm, the release arm is formed to include the tab-receiver notches, the lock-release pivot post is arranged to extend into a post receiver formed in a left-side portion of the second panel to support the pivotable lock-release rod for pivotable movement about the second-panel pivot axis.

15. The security gate of claim 14, wherein the rod coupler includes first and second glide flanges coupled to the release arm to locate the tab-receiver notches therebetween, a first rocker-glider flange coupled to the lock rod and arranged to rock and glide on the first flange-support rail during movement of the second panel relative to the first panel, and a second rocker-glider flange coupled to the lock rod and arranged to rock and glide on the second flange-support rail during motion of the pivotable lock-release rod relative to the pivotable lock rod and during movement of the second panel relative to the first panel.

16. The security gate of claim 14, wherein the first and second rocker-glider flanges and the first and second flange-support rails cooperate for allowing movement of the pivotable lock-release rod relative to pivotable lock rod and for allowing pivoting motion of the pivotable lock rod about the first-panel pivot axis and pivoting motion of the pivotable lock-release rod about the second-panel pivot axis to retain a free end of the upwardly extending tab in close proximity to the downwardly opening tab-receiver notches formed in the release arm without allowing movement of the tab into one of the tab-receiver notches during movement of the second panel relative to the first panel to widen or narrow the width of the variable-width screen.

17. A security gate comprising a variable-width screen including a first panel adapted to lie in a doorway and mate with a first doorjamb bordering the doorway and a second panel mounted on the first panel for sliding movement relative to the first panel to mate with an opposing second doorjamb bordering the doorway, and a hand-actuated panel mover coupled to the first and second panels and configured to provide for spreading the first and second panels apart to pressure-mount an outer edge of the first panel to the first doorjamb and an outer edge of the second door panel to the second doorjamb so that the panels are retained in stationary positions relative to one another and to the doorjambs to block juvenile movement through the doorway, the panel mover including a pivotable lock rod mounted on the first panel for pivotable movement about a first-panel pivot axis, a pivotable lock-release rod mounted on the second panel for pivotable movement about a second-panel pivot axis, and a rod coupler that is configured to tether a free end of the pivotable lock rod to move back and forth along a middle portion of the pivotable lock-release rod during relative movement of the first and second panels to widen or narrow the width of the variable-width screen, wherein the pivotable lock-release rod includes a release arm, a lock-release pivot post arranged on a first end of the release arm to extend into a post receiver formed in a left-side portion of the second panel, and a handgrip arranged on an opposite second end of the release arm, a portion of the release arm located between the lock-release pivot post and the handgrip is formed to include tab-receiver notches, the pivotable lock rod includes a lock arm and a lock pivot post arranged to extend into a post receiver formed in a right-side portion of the first panel, and the tab is coupled to a free end of the lock arm and arranged to extend upwardly in a direction toward the tab-receiver notches wherein the rod coupler includes cantilevered first and second flange-support rails arranged to lie in spaced-apart relation on the release arm of the pivotable lock-release rod to locate the tab-receiver notches therebetween and cantilevered first and second rocker-glider flanges arranged to lie in spaced-apart relation on the lock arm of the pivotable lock rod to locate the tab therebetween, the first rocker-glider flange is arranged to lie in mating engagement to the first flange-support rail to rock and glide back and forth thereon during movement of the first panel relative to the second panel after separation of the tab on the lock arm from the tab-receiver notches in the release arm, and the second rocker-glider flange is arranged to lie in mating engagement to the second flange-support rail to the second flange-support rail to rock and glide back and forth thereon during movement of the first panel relative to the second panel after separation of the tab on the lock arm from the tab-receiver notches in the release arm.

18. The security gate of claim 17, wherein a tab included in the pivotable lock rod can be inserted into a tab-receiver notch formed in the pivotable lock-release rod by pivoting the pivotable lock-release rod manually to rigidify the panel mover so as to block any further pivotable movement of the pivotable lock rod about the first-panel pivot axis and to block any further pivotable movement of the pivotable lock-release rod about the second-panel pivot axis so that once the panel mover is rigidified, movement of the second panel relative to the first panel is blocked and a fixed with of the variable-width screen is established.

19. The security gate of claim 17, wherein the pivotable lock-release rod is formed to include a series of separate tab-receiver notches extending along the length of the pivotable lock-release rod, the tab in the pivotable lock rod is sized and located to be inserted into any of the tab-receiver notches formed in the pivotable lock-release rod to anchor the pivotable lock-release rod to the pivotable lock rod to lock the first and second panels together so that relative movement between the first and second panels is blocked and the width of the variable-width screen is established.

20. The security gate of claim 19, wherein the pivotable lock-release rod is arranged to be pivoted upwardly away from a floor underlying the variable-width screen to disengage the tab from one of the tab-receiver notches to free the first and second panels for relative movement and then either drawing the panels together manually to establish a narrower width of variable-width screen or spreading the panels apart manually to establish a wider width of variable-width screen.

21. The security gate of claim 17, wherein the rod coupler is configured to provide for allowing movement of the pivotable lock-release rod relative to the pivotable lock rod and for allowing pivoting motion of the pivotable lock rod about the first-panel pivot axis and pivoting motion of the pivotable lock-release rod about the second-panel pivot axis to retain a free end of the tab included in the pivotable lock rod in close proximity to the tab-receiver notches formed in the pivotable lock-release rod without allowing movement of the tab into one of the tab-receiver notches during movement of the second panel relative to the first panel to widen or narrow the width of the variable-width screen.

22. A security gate comprising a variable-width screen including a first panel adapted to lie in a doorway and mate with a first doorjamb bordering the doorway and a second panel mounted on the first panel for sliding movement relative to the first panel to mate with an opposing second doorjamb bordering the doorway, and a hand-actuated panel mover coupled to the first and second panels and configured to provide for spreading the first and second panels apart to pressure-mount an outer edge of the first panel to the first doorjamb and outer edge of the second door panel to the second door jamb so that the panels are retained in stationary positions relative to one another and to the doorjambs to block juvenile movement through the doorway, the panel mover including a pivotable lock rod mounted on the first panel for pivotable movement about a first-panel pivot axis, a pivotable lock-release rod mounted on the second panel for pivotable movement about a second-panel pivot axis, and a rod coupler that is configured to tether a free end of the pivotable lock rod to move back and forth along a middle portion of the pivotable lock-release rod during relative movement of the first and second panels to widen or narrow the width of the variable-width screen, wherein the rod coupler is configured to provide means for allowing movement of the pivotable lock-release rod relative to the pivotable lock rod and for allowing pivoting motion of the pivotable lock rod about the first-panel pivot axis and pivoting motion of the pivotable lock-release rod about the second-panel pivot axis to retain a free end of a tab included in the pivotable lock rod in close proximity to a series of tab-receiver notches formed in the pivotable lock-release rod without allowing movement of the tab into one of the tab-receiver notches during movement of the second panel relative to the first panel to widen or narrow the width of the variable-width screen, and wherein the rod coupler includes a first flange-support rail coupled to the pivotable lock-release rod and a second flange-support rail coupled to the pivotable lock-release rod to lie in spaced-apart relation to the first flange-support rail to locate the downwardly opening tab-receiver notches therebetween, a first rocker-glider flange coupled to a free end of the pivotable lock rod and arranged to rock and glide on the first flange-support rail during movement of the second panel relative to the first panel, and a second rocker-glider flange coupled to a free end of the pivotable lock rod and arranged to rock and glide on the second flange support rail during movement of the second panel relative to the first panel.

23. The security gate of claim 22, wherein the tab included in the pivotable lock rod is positioned to lie between the first and second rocker glider flanges and extend upwardly toward the overlying downwardly opening tab-receiver notches formed in the pivotable lock-release rod.

* * * * *